United States Patent [19]

Wiedmer et al.

[11] Patent Number: 4,913,300

[45] Date of Patent: Apr. 3, 1990

[54] CLOSURE WITH GUARANTEE RING FOR CONTAINERS

[75] Inventors: Walter Wiedmer, Ascona; Ernst Wiedmer, Näfels, both of Switzerland

[73] Assignee: Walter Wiedmar AG Plastikform, Nafels, Switzerland

[21] Appl. No.: 264,944

[22] PCT Filed: Jan. 27, 1988

[86] PCT No.: PCT/CH88/00017

§ 371 Date: Sep. 13, 1988

§ 102(e) Date: Sep. 13, 1988

[87] PCT Pub. No.: WO88/05754

PCT Pub. Date: Aug. 11, 1988

[30] Foreign Application Priority Data

Jan. 30, 1987 [CH] Switzerland ..... 331/87

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,322,012 | 3/1982 | Conti | 215/252 |
| 4,488,655 | 12/1984 | Itsubo et al. | 215/252 |
| 4,511,054 | 4/1985 | Shank | 215/252 |
| 4,526,282 | 7/1985 | Dutt | 215/252 |
| 4,530,436 | 7/1985 | Wiedmer | 215/252 X |
| 4,667,838 | 5/1987 | Yeager | 215/252 |

FOREIGN PATENT DOCUMENTS

| | | | |
|---|---|---|---|
| 146237 | 6/1985 | European Pat. Off. . | |
| 158477 | 10/1985 | European Pat. Off. . | |
| 3439212 | 2/1986 | Fed. Rep. of Germany . | |
| 2439138 | 5/1980 | France . | |
| 1181858 | 2/1970 | United Kingdom . | |
| 1438648 | 6/1976 | United Kingdom | 215/252 |
| 2111031 | 6/1983 | United Kingdom . | |

*Primary Examiner*—Donald F. Norton

*Attorney, Agent, or Firm*—Ladas & Parry

[57] ABSTRACT

The closure has a body (1) and a guarantee ring (2) connected to it. The hooks (5) applied to the guarantee ring (2) and intended to separate the latter (2) from the body (1) of the closure upon removal of the closure from the container are each equipped with a slide wedge (8). This wedge may perferably be in the middle of the hook which extends longitudinally along the periphery of the closure. The wedge (8) has a slide face (11) of a width (b) that is about a quarter of the length (L) of the hook (5). The slide face (11) is inclined to the interior wall (4) of the guarantee ring preferably at an angle ($\alpha$) of 31 degrees and initiates at the lower rim (9) of the guarantee ring in order to improve the machine-operated placing of the closure onto the container.

10 Claims, 1 Drawing Sheet

CLOSURE WITH GUARANTEE RING FOR CONTAINERS

Figure 1:
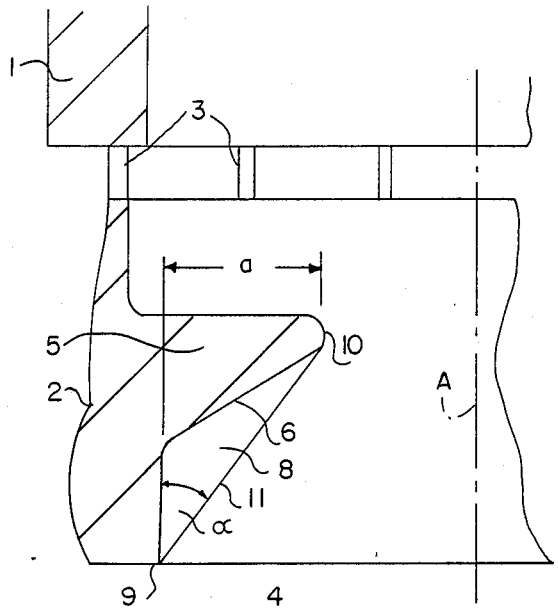

The invention relates to a closure for containers, having a guarantee ring on its lower side which is provided on its interior wall with hook-like protrusions that extend inwardly and upwardly and engage the container when the closure is removed, effecting in this manner a separation of the guarantee ring, from the body of the closure.

These protrusions or hooks are below the mouth of the closure when the closure is mounted. As a rule said mouth has a larger diameter than the adjacent neck of the container. The free ends or tips of these hooks are at such a distance from the longitudinal axis of the container and thus also of the closure that this distance is inferior to the radius of said container mouth. When the closure is removed, the hooks therefore engage the lower side of the container mouth. The guarantee ring, linked to the closure body by means of thin bridge-like strips, thus becomes separated from the latter. The first opening of the closure is therefore indicated.

Hooks of this kind are known from the prior art, e.g. from U.S. Pat. No. 4 488 655. The hooks are formed as individual protrusions spread over the periphery. An annular hook, i.e. a hook extending over the entire periphery, has also been proposed. Both the upper and the lower side of the hooks have a distinctive inclination with regard to the interior wall of the guarantee ring from which they protrude. The angle of inclination is rather wide, as a rule between 50 and 60 degrees. However, the upper side may even have a still wider angle, up to 90 degrees.

Besides hooks of this shape, others have been proposed which protrude not obliquely in an axially upward direction but horizontally from the interior wall. They have so to say a smaller radius than one of the interior wall. Their resistance against the removal of the closure, however, is lower as on the hooks extending obliquely upwards so that they were not successful. Above all there aue problems arising with them during the placing of the closures onto the containers. The hooks must namely slip over the container mouth which has a larger diameter, and they are required to snugly lie against the interior wall of the guarantee ring. Only after having reached the thinner neck of the container, they can resume their original position in which they protrude again from the interior wall. It is obvious that the wedge-like hooks extending obliquely in an upward direction are better than the embodiments previously referred to.

However, even with the oblique hooks just mentioned, problems arise in daily use when the closure is mounted. The container filling machines, in particular those used in the beverage industry, are laid out for such extreme high hourly ratings that only very little time is allowed for mounting the closure. Within this brief period the closure is required to slip over the container mouth and the guarantee ring, having a smaller diameter but meeting the container mouth first during mounting, must widen itself elastically. The thin strips connecting the guarantee ring with the closure body are in fact required to push the guarantee ring in front of them without becoming damaged.

Experience has shown that the present hooks obstruct or block the mounting procedure of the closure. Obviously they were inclined too much with regard to the direction of the mounting movement and thus acted like rigid obstacles. An elastic widening within the brief period just mentioned was not possible or, at the most, in an insufficient manner. The guarantee rings therefore piled up at the container mouths which led to the upsetting of the connecting strips. The closures could no longer be mounted because their space was taken up by the guarantee rings which had not slipped over the container mouths. Troubles during the filling process were the result of it. Other troubles, too, could occur such as e.g. a bursting of guarantee rings.

It is an object of the invention to avoid these difficulties, which utterly hamper the filling procedure, by providing a closure whose characteristic features appear in claim 1.

By providing a new form for the hooks of the closures according to the invention both an improvement of the characteristics of the closure with regard to its machine-operated mounting and are increase in the efficiency of the hooks during unscrewing of the closure from the container are achieved. Further it is to be noted that the new form of the closure does not result in a complication and with it in a increase in the costs of manufacturing the closures by injection moulding. Thus a combination of characteristics was achieved that was not obvious to the persons skilled in the art.

Figure 2:
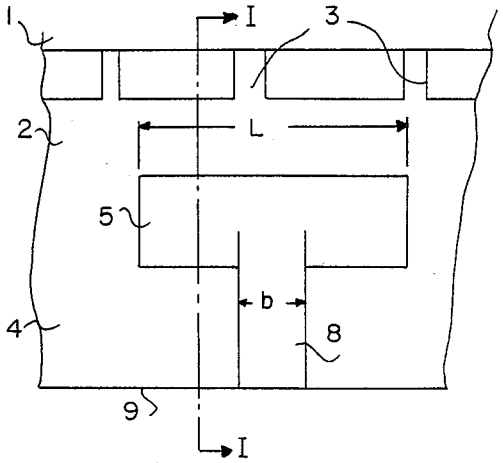
Figure 3:
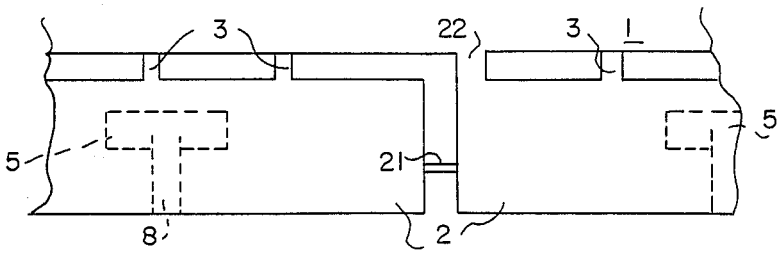

The invention will now be explained in more detail by referring to the annexed drawings wherein FIG. 1 illustrates a section through the guarantee ring and the lower part of the closure according to line I—I in FIG. 2, FIG. 2 discloses a view of the guarantee ring over a part of its periphery, and FIG. 3 represents a schematic developed view of a preferred embodiment of the closure.

Reference numeral 1 designates a closure body and 2 the guarantee ring connected to it by means of strips 3. On its interior wall 4 a number of hooks extend over a part of its periphery. As a rule three such hooks, spread evenly over the periphery, are provided. Only one of them is illustrated in the drawings. Such a hook has a lowr side 6 extending obliquely from the interior wall 4 in an upward direction and a horizontal upper side 7. As is obvious from the hatching in FIG. 1, body 1, guarantee ring 2, strips 3 and hooks 5 form a single piece made in one injection molding step.

As can be seen particularly from FIG. 2, a inlet or slide wedge 8 is arranged on the middle of hook 5. This wedge extends obliquely in an upward direction, initiating at the lower rim 9 of guarantee ring 2 and blending tangentially into rounded tip 10 of hook 5. The angle $\alpha$ with which the slide face 11 of wedge 8 is inclined with regard to vertical interior wall 4 of guarantee ring 2 is preferably 31 degrees; this value has been determinated in trials and represents an optimum. This optimum even determines the distance of a tip 10 of hook 5 from interior wall 4. How far hook 5 is allowed to protrude from interior wall 4, depends therefore on one hand from said angle a and on the other hand from the height of hook 5 above lower rim 9 of guarantee ring 2. However, it is obvious that tip 10 must extend so far towards the interior that hook 5 still can fulfil its purpose. Tip 10 therefore must be within the profile of the container mouth, or, in other words, must be closer to the longitudinal axis A represented in FIG. 1 than the wall of the container mouth because it is required to contact the lower side of the mouth upon removal of the closure.

Preferably only one slide wedge 8 for each hook 5 is provided, and therefore this wedge is disposed symmetrically with regard to the hook, i.e. in the middle of the latter. One slide wedge is, as a rule, sufficient; secondly, consideration must be given to the fact that as little material as possible ought to be used for manufacturing the closure. This is of decisive importance in view of the enormous number of closures produced even if the quantity is very small for the individual closure. A third aspect to be observed is the fact that slide wedge 8 must not stiffen guarantee ring 2 too much since otherwise the danger of the operational troubles already referred to might arise again; the guarantee ring must be able to widen itself elastically during placing of the closure on the container, inspite of the presence of its wedges. This is the reason why it would make little sense to incline lower side 6 of hook 5 by angle $\alpha$ already mentioned instead of wedge 8, i.e. to form hook 5 itself as a wedge over its entire width. This would consume to much material as stated before and would reduce elasticity. Tests have shown that width b of slide wedge 8 is preferably selected to be a quarter of length L of hook 5. An exception of this value may be admitted if a great number of very small hooks 5 are provided. Then width b of wedge 8 may exceptionally correspond to the very small length L of hook 5.

It is also important that wedge 8 initiates exactly at lower rim 9 of guarantee ring 2 and does not protrude farther above from interior wall 4. If the latter would be the case, guarantee ring 2 would again have a purely cylindrical shape below these slide wedge, which once more would lead to the troubles already mentioned. The slide wedges therefore must extend to the rim 9 so that they become immediately effective during placing of the closure onto the container.

FIG. 3 illustrates a developed view of a preferred embodiment of the closure with guarantee ring according to the invention. Reference numeral 21 refers to a bridge for the guarantee ring 2 which is interrupted at this place. The ring is, at this location, also secured to the closure body 1 by means of a stronger strip 22. Said interruption therefore acts clearly as a predetermined breaking point. On this embodiment of guarantee ring 2, known per se, the ring not only will be separated from body 1 but also becomes split so that it hangs down obliquely, indicating clearly the first opening of the closure. In order to ensure the bearing of bridge 21 on its one or other end from guarantee ring 2, it is recommended that the latter is not made to stiff at this location which means that the hooks should be arranged at a certain distance from said location as illustrated. This also facilitates the manufacturing of the mould for the production of the closures. The mould for the closure as shown is very complicated but enables, due to this, a high number of closures to be made within a given unit of time. The combination as described of a guarantee ring with hooks on one hand and of said interruption in the ring substantially increases the safe use of the closure according to the invention.

We claim:

1. A closure for containers, said closure comprising:

a guarantee ring, said ring having a lower rim, an interior wall and hooks extending from the interior wall of the ring, said hooks having a tip;

at least one slide edge disposed on each hook, said wedge extending from the lower rim of the guarantee ring to the tip and permitting the guarantee ring of said closure to slip over a neck portion of the container, said wedge having a width that is substantially $\frac{1}{4}$ of a length of said hook.

2. A closure as claimed in claim 1 wherein said slide wedge has a slide face (11) inclined at an angle ($\alpha$) of substantially 31 degrees to the interior wall (4) of the guarantee ring.

3. A closure as claimed in claim 2, wherein said slide face blends tangentially into the tip (10) of the hook (5).

4. A closure as claimed in claim 2, wherein each slide wedge has one hook disposed on said slide wedge, said hook having a longitudinal extension, and the slide wedge is symmetrically arranged in the middle portion of the longitudinal extension.

5. A closure for containers, said closure comprising:

a guarantee ring, said ring having a lower rim, an interior wall and hooks extending from the interior wall of the ring, said hooks having a tip;

at least one slide wedge disposed on each hook, said wedge extending from the lower rim of the guarantee ring to the tip and permitting the guarantee ring of said closure to slip over a neck portion of the container, said slide wedge having a slide face inclined at an angle (a) of substantially 31 degrees to the interior wall of the guarantee ring.

6. A closure as claimed in claim 5, wherein said slide face blends tangentially into the tip.

7. A closure as claimed in claim 5 wherein each slide wedge has one hook disposed on said slide wedge, said hook having a longitudinal extension, and the slide wedge is symmetrically arranged in the middle portion of the longitudinal extension.

8. A closure as claimed in claim 7 wherein the slide wedge has a width (b), the hook has a length (L), and b is approximately one fourth of L.

9. A closure as claimed in claim 5 wherein the slide wedge has a width (b), the hook has a length (L), and b is approximately one fourth of L.

10. A closure for containers, said closure comprising:

a guarantee ring, said ring having a lower rim, an interior wall and hooks extending from the interior wall of the ring, said hooks having a tip;

a body;

means for connecting said ring with said body;

at least one slide wedge disposed on each hook, said wedge extending from the lower rim of the guarantee ring to the tip and having a slide face that is inclined at an angle of approximately 31 degrees to the interior wall of the guarantee ring, said wedge having a width b and said hook having a length L, width b being less than length L, said wedge permitting the guarantee ring of said closure to slip over a neck portion of the container.

* * * * *